US006439584B1

(12) United States Patent
Lai

(10) Patent No.: US 6,439,584 B1
(45) Date of Patent: Aug. 27, 2002

(54) ROLLER-SKATING BOOT

(76) Inventor: Eric Lai, No. 37, Tai Jui 1st Street, Chia Yi City (TW)

( * ) Notice: Subject to any disclaimer, the term of this patent is extended or adjusted under 35 U.S.C. 154(b) by 0 days.

(21) Appl. No.: 10/083,526

(22) Filed: Feb. 27, 2002

(51) Int. Cl.[7] ..... A63C 17/00
(52) U.S. Cl. ..... 280/11.27; 280/11.221
(58) Field of Search ..... 280/7.13, 842, 280/11.19, 11.221, 11.223, 11.231, 11.27, 11.28, 87.041, 87.042

(56) References Cited

U.S. PATENT DOCUMENTS 1,026,712 A * 5/1912 Simon ..... 280/11.28
1,632,997 A * 6/1927 Connolly ..... 280/11.28
2,290,523 A * 7/1942 Bauer ..... 280/11.28
2,430,037 A * 11/1947 Vincent ..... 280/11.27
4,657,265 A * 4/1987 Ruth ..... 280/11.27
5,551,713 A * 9/1996 Alexander ..... 280/11.27
5,620,190 A * 4/1997 Maggiore ..... 280/11.27
6,299,186 B1 * 10/2001 Kao et al. ..... 280/11.28

* cited by examiner

*Primary Examiner*—Michael Mar
(74) *Attorney, Agent, or Firm*—Rosenberg, Klein & Lee

(57) ABSTRACT

A roller-skating boot has a wheel support turnably fitted to a front connecting portion of the sole thereof. Two front wheels are provided at two ends of the wheel support such that the user can be supported with increased stability by the side-by-side arranged front wheels and other wheels that are arranged in one line behind the front wheels. The wheel support has a protrusion sticking up to be movably confined in a guide trench of the front connecting portion so as to limit the change of orientation of the wheel support in relation to the sole to a certain range.

2 Claims, 5 Drawing Sheets

ROLLER-SKATING BOOT

BACKGROUND OF THE INVENTION

The present invention relates to a roller-skating boot, more particularly a roller-skating boot, which can support the wearer thereof relatively stably on a surface, and which allows the wearer to easily change the moving direction as well as perform various maneuvers Kickboards, inline skates, skateboards, and roller skates have been very popular for a long time. Skating on them is the favorite sport for many people, especially young people. A kickboard basically includes a wheeled skateboard, and a handle connected to the front end of the skateboard for the user to control the direction. An inline skate has several wheels arranged in one line and connected to the sole of a boot part thereof. Skating on a pair of inline skates to perform various maneuvers and move quickly is very popular with teenagers.

However, beginners are prone to fall over when skating on inline skates because the wheels of each inline skate are arranged in one line, unable to support the user as stably as roller-skates, each of which has four wheels arranged in two lines.

SUMMARY OF THE INVENTION

Therefore, it is a main object of the present invention to provide a roller-skating boot which can stably support the user skating on it on a surface.

And, it is another object of the present invention to provide a roller-skating boot, of which the support for the frontmost wheels can be unlocked to be movable from a fixed position according to needs. It is a third object of the present invention to provide the roller-skate boot such that the movement of the support of the front wheels is limited to a certain range when the support is in the unlocked position.

The roller-skating boot has a wheel support turnably fitted to a connecting member connected to the front end of the sole thereof. The wheel support is equipped with two front wheels at two ends such that the boot has two side-by-side arranged front wheels and other wheels, which are arranged in one line behind the front wheels. The wheel support has a protrusion movably confined in a guide trench of the connecting member such that the change of the orientation thereof in relation to the sole is limited to an appropriate range.

BRIEF DESCRIPTION OF THE DRAWINGS

The present invention will be better understood by reference to the accompanying drawings, wherein.

DETAILED DESCRIPTION OF THE PREFERRED EMBODIMENT

Figure 1:
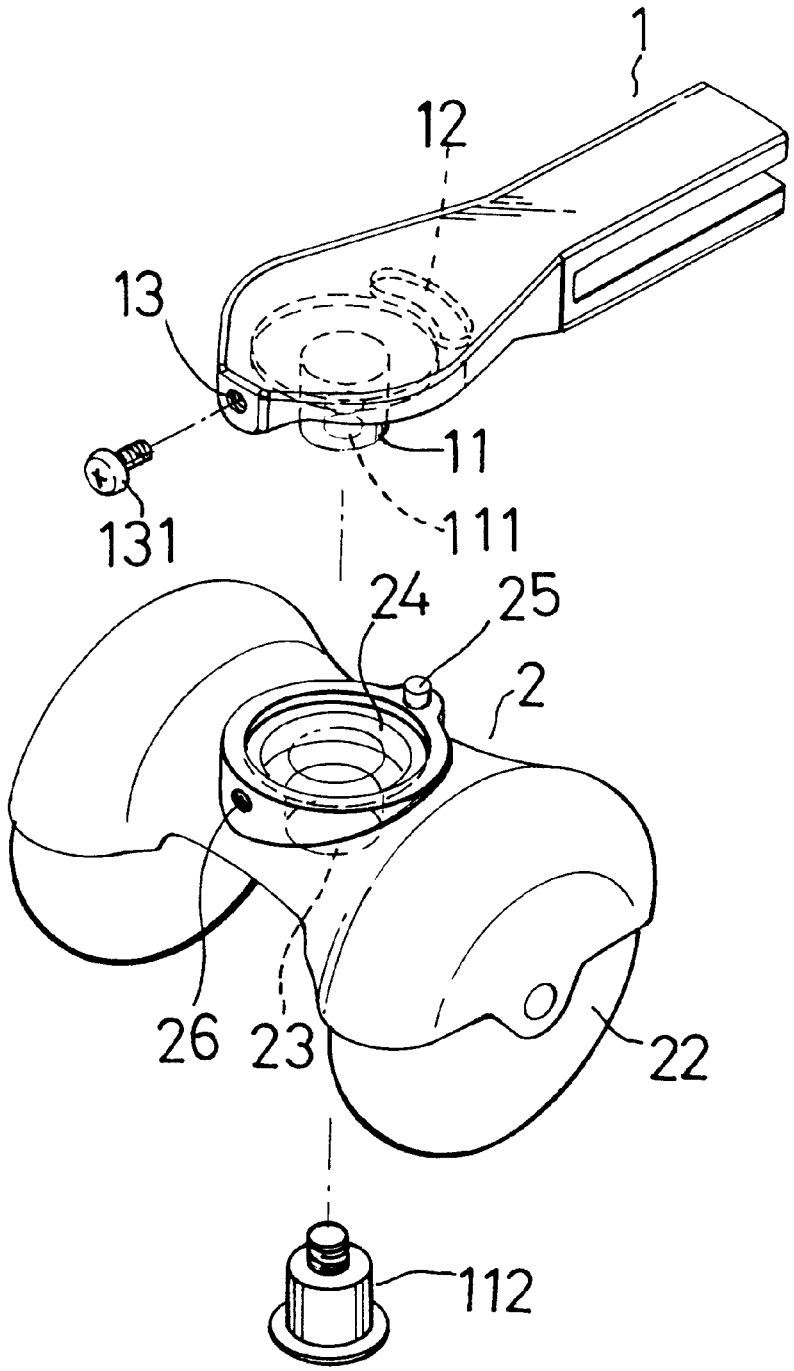
FIG. 1 is an exploded perspective view of the front part of the roller-skating boot of the present invention.

Referring to FIGS. 1 to 4, a roller-skating boot of the present invention includes a boot part 31, a sole part 3, and a front part, which consists of a connecting member 1, a wheel support 2, and two front wheels 22.

Figure 3:
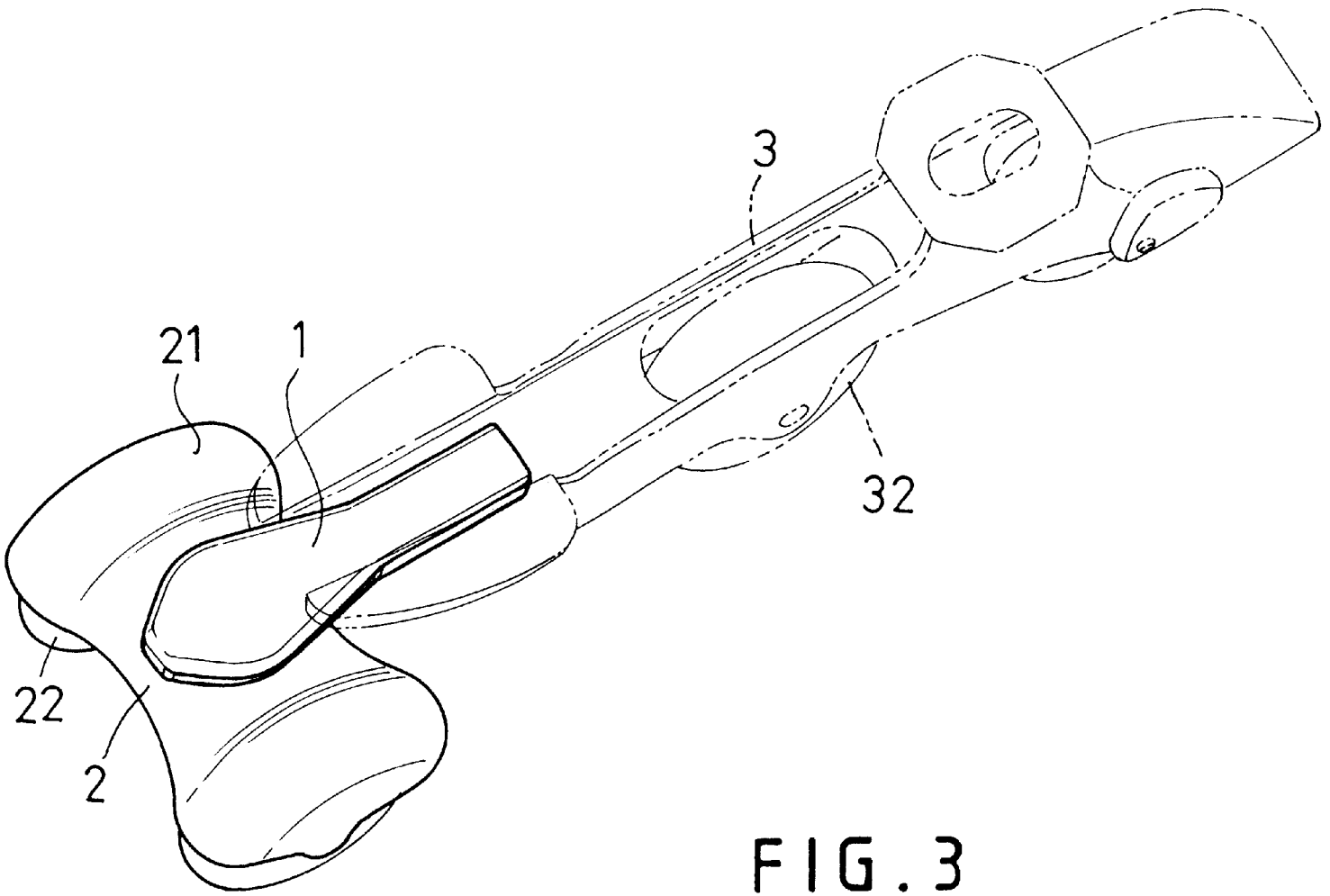
FIG. 3 is a top view of the main frame of the roller-skating boot of the present invention.
Figure 4:
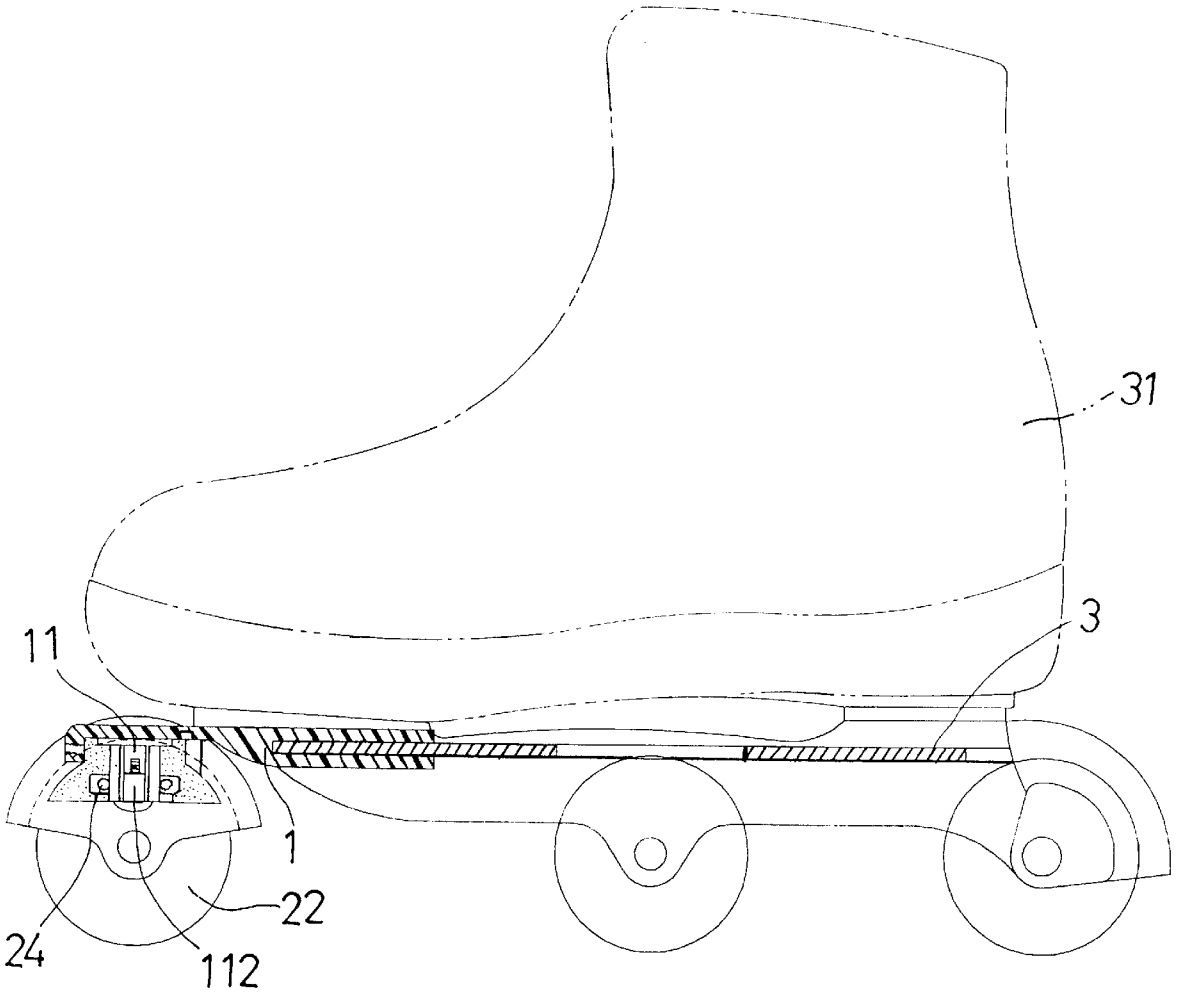
FIG. 4 is a side view of the roller-skating boot of the present invention.

As shown in FIGS. 3 and 4, the sole part 3 is formed by an elongated frame member. The boot part 31 is attached to an upper surface of the elongated frame member. Two in-line wheels are rotatably supported by the elongated frame member. The connecting member 1 is connected to the elongated frame member by an elongated slot formed in a rearward portion of the connecting member 1 which slidably receives a forward end of the elongated frame member.

Figure 2:
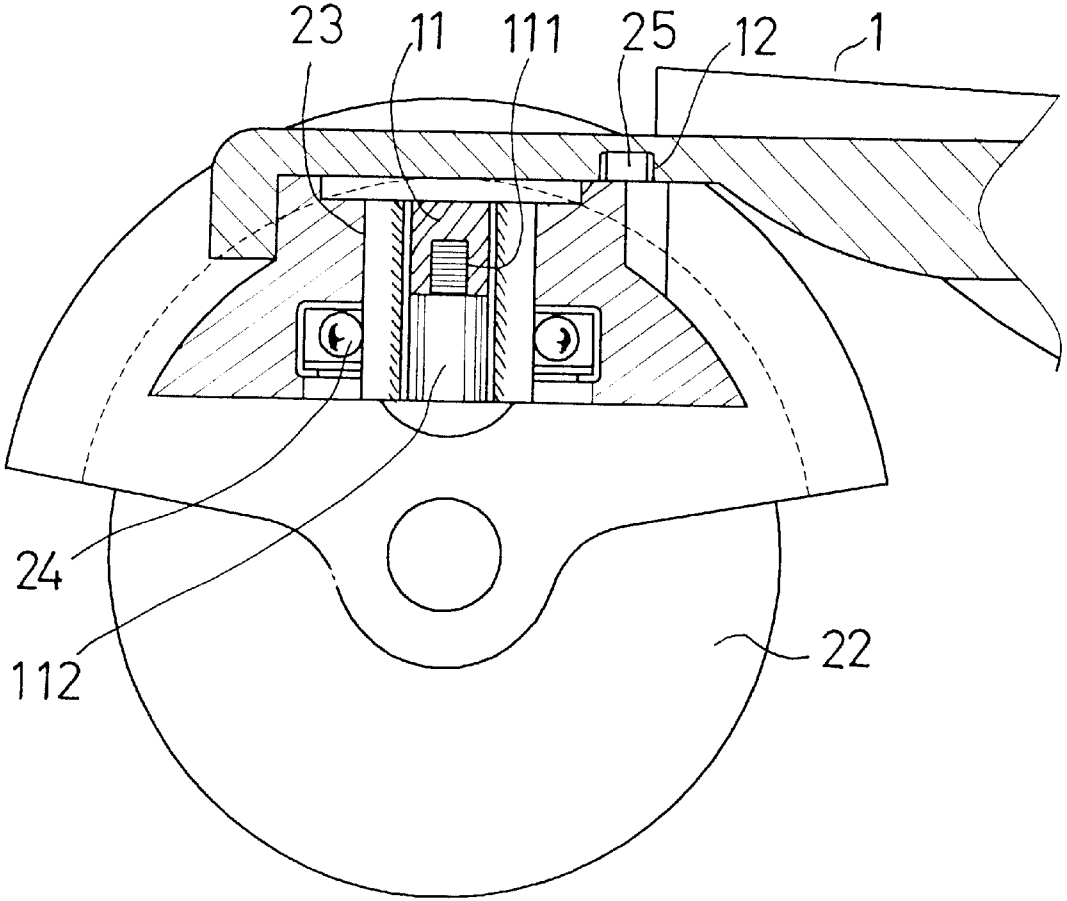
FIG. 2 is a lateral cross-section view of the front part of the roller-skating boot of the present invention.

Referring specifically to FIGS. 1 and 2, the connecting member 1 has a pivotal rod 11 sticking downwards at the front portion, a guide trench 12 behind the pivotal rod 11, and a through hole 13 on the front side. The pivotal rod 11 has a screw hole 111 on the lower side thereof. The front wheels 22 are turnably fitted to two sides of the wheel support 2. The wheel support 2 has a receiving hole 23 in the middle, a protrusion 25 sticking upwards from behind the receiving hole 23, and a screw hole 26 formed on the middle of the front side. A bearing 24 is fitted into the receiving hole 23 of the wheel support 2. The wheel support 2 is turnably connected to the connecting member 1 with the bearing 24 being passed around the pivotal rod 11 and with the upwards sticking protrusion 25 being received in the down facing guide trench 12 of the connecting member 1; a fixing element 112 is passed through the bearing 24 and screwed into the screw hole 111 of the pivotal rod 11 of the connecting member 1 such that the wheel support 2 can't fall off.

Thus, the front portion of the boot is supported by means of both of the front wheels 22, which are arranged side by side. And, the direction of the front wheels 22 can change together with the wheel support 2 turnably connected to the connecting member 1; the change of the direction of the front wheels 22 is limited to a ranged defined by the guide trench 12 because the pivotal rod 11 is movably confined in the guide trench 12.

Figure 6:
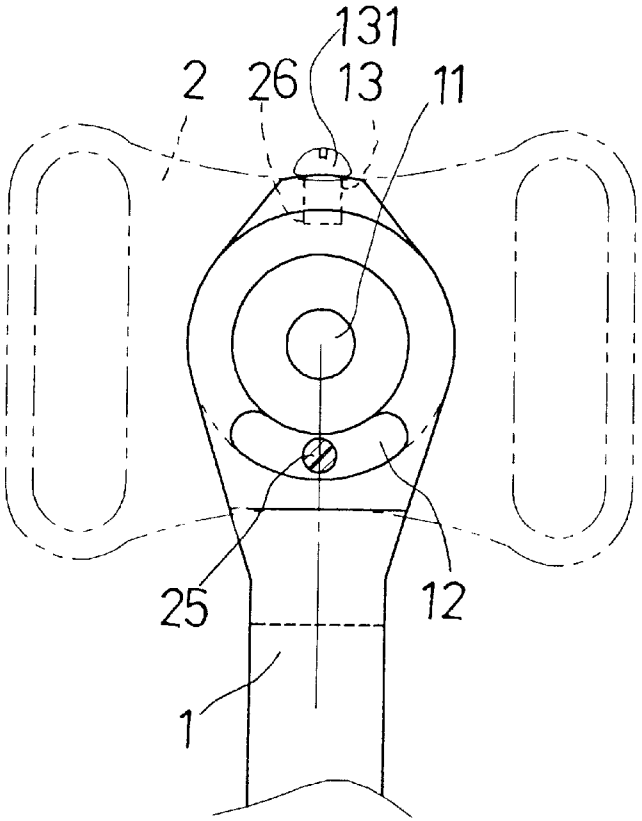
FIG. 6 is a view showing the wheel support being locked in the forward position according to the present invention.
Figure 5:
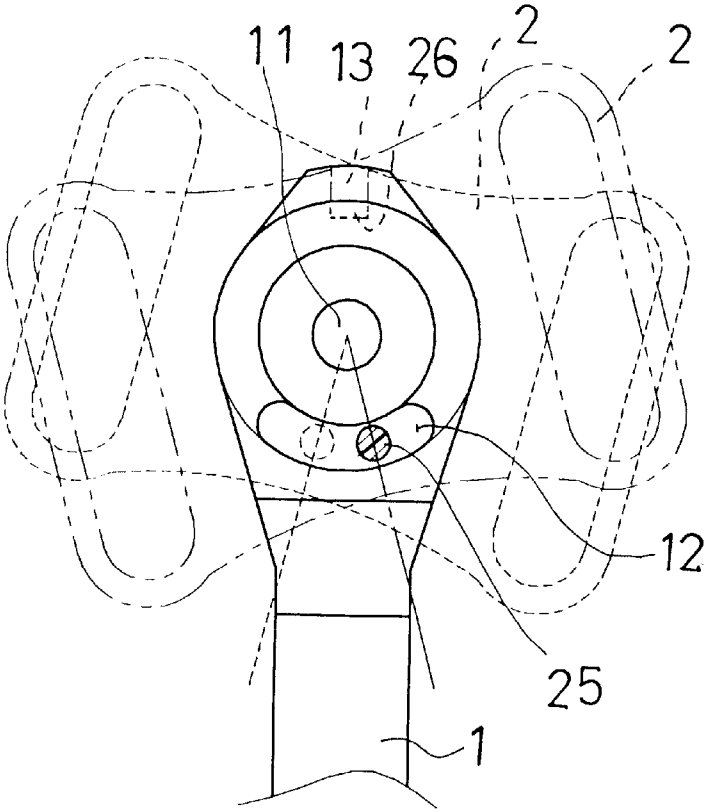
FIG. 5 is a view showing the wheel support being in the unlocked position to be turnable according to the present invention.

Furthermore, when the user wants to fix the wheel support 2 in position, i.e. prevent the orientation of the front wheels in relation to the sole part 3 from changing, he can pass a locking screw 131 through the through hole 13 and screw same into the screw hole 26 of the wheel support 2, as shown in FIG. 6.

From the above description, it can be easily understood that the rollers-skating boot of the present invention has advantages as the followings:

1. The boot can support the user on a surface when he is skating on it relatively stably as compared with inline skates because it has two front wheels arranged side by side.

2. Because the wheel support 2 can turn about the pivotal rod 11, the boot allows the user to turn easily in skating.

3. A change of the direction of the wheel support 2 is limited to a proper range by means of confining the protrusion 25 of the wheel support 2 in the guide trench 12, therefore the boot is relatively safe to skate on.

4. The orientation of the front wheels 22 can be fixed according to the user's needs by means of passing the locking screw 131 through the hole 13 and screwing same into the screw hole 26 to lock the wheel support 2 in position.

5. The user can lock the wheel support of one of a pair of skating boots in position and unlock the wheel support of the other such that he can perform special maneuvers.

What is claimed is:

1. A roller skate comprising:

a boot;

a frame member attached to a lower portion of said boot, at least two in-line wheels rotatably supported by said frame member;

a connecting member connected to said frame member, said connecting member having a slot formed therein for receiving a front end portion of said frame member, a downwardly extending pivot rod, and a guide trench formed in a lower surface of said connecting member; and a front wheel assembly including a wheel support defining a receiving hole receiving a bearing therein, said pivot rod being received within said bearing, a fixing member extending into said receiving hole to engage said pivot rod for retaining said pivot rod within said bearing, an upward protrusion being formed on said wheel support to engage said guide trench for limiting pivotal movement of said wheel support to a predetermined range of angular displacement relative to said connecting member, and a pair of laterally spaced wheels rotatably coupled to said wheel support.

2. The roller skate as claimed in claim 1, further including a locking screw extendable through a hole formed at a front end of said connecting member to engage a screw hole formed in said wheel support, said locking screw being selectively engageable with said screw hole for locking said wheel support at a selected angular position relative to said connecting member.

* * * * *